US010738424B2

(12) United States Patent
Journeaux

(10) Patent No.: US 10,738,424 B2
(45) Date of Patent: Aug. 11, 2020

(54) SYSTEM AND METHOD FOR MITIGATING ROCKFALLS

(71) Applicant: R&B Leasing, LLC, Grand Junction, CO (US)

(72) Inventor: Daniel Lorne Journeaux, Ontario (CA)

(73) Assignee: R&B LEASING, LLC, Grand Junction, CO (US)

( * ) Notice: Subject to any disclaimer, the term of this patent is extended or adjusted under 35 U.S.C. 154(b) by 512 days.

(21) Appl. No.: 15/669,617

(22) Filed: Aug. 4, 2017

(65) Prior Publication Data

US 2019/0040594 A1 Feb. 7, 2019

(51) Int. Cl.
*E01F 7/04* (2006.01)

(52) U.S. Cl.
CPC ..... *E01F 7/045* (2013.01)

(58) Field of Classification Search
CPC ... E01F 7/045; E01F 7/00; E01F 7/025; E01F 7/04
See application file for complete search history.

(56) References Cited

U.S. PATENT DOCUMENTS

| | | | | |
|---|---|---|---|---|
| 3,274,783 | A | 9/1966 | Handy | |
| 5,186,438 | A * | 2/1993 | Cross | E01F 7/04 256/12.5 |
| 5,299,781 | A * | 4/1994 | Barrett | E04H 17/08 256/1 |
| 5,961,099 | A * | 10/1999 | Thommen, Jr. | E01F 7/04 256/12.5 |
| 5,996,972 | A | 12/1999 | Kaiser | |
| 6,247,873 | B1 | 6/2001 | Fukui | |
| 6,279,858 | B1 | 8/2001 | Eicher | |
| 7,384,217 | B1 | 6/2008 | Barrett et al. | |
| 7,455,480 | B2 | 11/2008 | Melegari | |
| 7,708,502 | B2 | 5/2010 | Carte et al. | |
| 8,079,571 | B2 | 12/2011 | Nishita et al. | |
| 8,955,655 | B2 | 2/2015 | Von Allmen et al. | |
| 9,031,791 | B2 | 5/2015 | Nedilko et al. | |
| 9,309,636 | B2 | 4/2016 | Wyllie | |
| 2004/0041139 | A1 | 3/2004 | Rambaud | |
| 2018/0274618 | A1 * | 9/2018 | Ng | F16F 3/04 |

FOREIGN PATENT DOCUMENTS

| | | | | |
|---|---|---|---|---|
| EP | 1130166 | A2 | 9/2001 | |
| FR | 2669047 | A1 * | 5/1992 | E01F 7/045 |
| FR | 3054576 | A1 * | 2/2018 | E01F 7/025 |
| WO | WO-2018215216 | A1 * | 11/2018 | E01F 7/04 |

* cited by examiner

*Primary Examiner* — Jonathan P Masinick
(74) *Attorney, Agent, or Firm* — Berg Hill Greenleaf Ruscitti, LLP

(57) ABSTRACT

A system of the invention includes at least one barrier layer, a plurality of rockfall attenuators, and two primary anchor points to anchor opposite lateral sides of the barrier layer. The attenuators may be secured to an upper portion of the barrier layer. The attenuators create a gap or separation between the surfaces of the slope upon which the barrier layer is installed. The attenuators may be secured to the barrier mesh by a single cable routed through cable eyes formed on each of the attenuators. Opposite ends of the cable are secured to the sloping surface by the two primary anchor points. The attenuators are free floating members in that they are not attached to the sloping surface. The invention further includes attenuators as a sub-combination and a method of installing the system.

18 Claims, 6 Drawing Sheets

SYSTEM AND METHOD FOR MITIGATING ROCKFALLS

FIELD OF THE INVENTION

The invention relates to barriers for protecting personnel and equipment from falling rocks and earth, such as caused by rockfalls and landslides that may occur on a sloping surface, and more particularly, to a system and method of mitigating damage from rockfalls and landslides including at least one barrier layer and a plurality of rockfall attenuators mounted to the sloping surface.

BACKGROUND OF THE INVENTION

Rockfalls are generally defined as groups of loose rocks or rock formations that become dislodged from a rock face under the influence of gravity. Rockfalls present a significant hazard for personnel and equipment that may be present in the pathway of the rockfall. An active rockfall area can be extremely hazardous; a falling rock contains a tremendous amount of energy, and even relatively small rocks can cause significant damage to equipment and structures, and can cause loss of life.

There are a number of mitigation techniques available to reduce the potential damage from rockfall. During construction practices, it is often necessary to provide temporary protection from rockfalls. One type of commonly used temporary barrier includes the use of a flexible barrier such as metal fencing or mesh that is secured by anchors to the slope at designated locations that is subject to rockfall events. If a rockfall occurs, the rock and associated debris are routed under the flexible barrier and between the mesh and the rockfall face. This channeling effect controls the fall of rocks and debris to prevent the rocks from free falling and causing potentially devastating damage to equipment and potential loss of life An additional measure for mitigation is to excavate a catch basin at the base of the slope so any falling rocks are caught within the basin and therefore cannot fall below the location of the basin.

There are a number of US and foreign patent references that disclose barrier systems to mitigate damage from rockfalls. Some of these references provide complex flexible barrier configurations while others employ a large number of anchors or posts for supporting one or more flexible barrier members. One common theme however in most if not all of these references is that they are complex and require significant resources and manpower to install.

While there may be a number of solutions available for limiting the hazards associated with rockfalls and landslides, there are some inherent drawbacks with many of these solutions. For rockfall barriers that incorporate anchors such as metal posts to secure the metal barrier fencing, it can be very difficult to install the requisite number of posts on difficult to access sloping surfaces where rockfalls are actively occurring. Furthermore, the posts are commonly designed to break away or bend if the posts receive a direct hit from a falling rock or if the mesh experiences an excessive impact from falling rocks and debris. As a result of a direct hit or the force of many rocks striking the barrier fencing adjacent a post, the post must be replaced in many circumstances which require additional resources and manpower to repair or reset the system. For larger more catastrophic rockfalls, a number of adjacent posts may be destroyed which can further compromise the overall integrity of the barrier system, and may allow the escape of falling rocks and debris.

Therefore, there is a need to provide a rockfall barrier system that is capable of withstanding direct hits from rocks and falling debris without having to individually replace each post or anchor system that is used to hold the fencing. There is also a need to provide a rockfall barrier system that is easy to install, repair, and to minimize the length of exposure time of personnel to rockfall hazards. There is also a need to provide a rockfall barrier system that can effectively achieve dissipation of the energy associated with a rockfall in a cost-effective manner yet ensuring the safety of personnel and equipment that may be located in the rockslide area.

SUMMARY OF THE INVENTION

The invention includes a system and method for mitigating rockfalls and landslides. As used herein, the term "rockfalls" is not limited to mitigation of only falling rocks, but also associated debris such as earth and other miscellaneous debris that may be carried downward by the force of rocks that may strike a sloping surface. In order to simplify the description of the invention herein, the term "rockfall" also includes events that may be more accurately characterized as landslides in which a greater percentage of earth may move down slope as compared to rocks. Therefore, it should be understood that the system and method of the invention is equally applicable for mitigating rockfalls, landslides, or any other characterizations of objects that may fall down a sloping surface as a result of gravity.

In a preferred embodiment of a system of the invention, it includes a primary barrier layer covering a rockfall area, one or more secondary barrier layers, and a plurality of rockfall attenuators or bumpers selectively disposed along the primary barrier layer to provide structure for holding the barrier layers against the rockfall area. A rockfall area typically includes a sloping surface over which rock and debris may fall. The primary barrier layer may be made of a selected mesh material. The one or more secondary barrier layers may be made of finer and lighter mesh material as compared to the primary barrier layer. The attenuators are "free floating", members in that they are not attached to the sloping surface.

According to one feature of the invention, the rockfall attenuators or bumpers are provided to not only hold the barrier layer(s) against a sloping surface and to provide the necessary gaps between the sloping surface and the barrier layers to trap incoming rocks from the rockfall event, but the rockfall attenuators are also employed to provide substantial energy absorption for rocks that may strike the attenuators.

According to a preferred embodiment of the attenuators or bumpers, they comprise an inflatable member made of a resilient and flexible material such as rubber, a selected thermoplastic, or combinations thereof. During a rockfall event, rocks striking the attenuators or bumpers are slowed due to a "bounce" effect in which energy is absorbed by the compression and subsequent expansion of the attenuators or bumpers. Because the attenuators are not directly attached to the sloping surface, rocks are allowed to flow beneath the individual attenuators and in the gaps between the adjacent attenuators, thereby facilitating the necessary control of rocks and debris as the material moves down slope. Further, because of the resilient nature of the bumpers/attenuators, a direct hit by a rock or other debris will not destroy the bumpers/attenuators and rather, and at least some of the energy from the strike will be directly absorbed by the struck bumper/attenuator.

A shape of the attenuators may be selected to achieve desired functionality associated with use of the attenuators at a specific job site. For example, the attenuators could be spherical shaped or cylindrical shaped in which the curved or rounded exterior surface of the attenuator would be in contact with the sloping surface to accommodate a bounce effect against the slope in response to a direct rock hit or in response to a flow of material beneath the attenuators.

The attenuators may be resilient inflatable members selectively spaced from one another to provide a necessary separation of the barrier layer from the slope. As mentioned, the attenuators also provide supplemental force resistance against a rockfall event in which the attenuators provide a reaction force due to their resilient construction.

Another advantage of using resilient and flexible attenuators is that they are capable of being installed on sloping surfaces having an infinite number of undulations or irregularities. The lower surface of the attenuators will naturally rest against any underlying surface and without the necessity of installing a dedicated post or anchor at that location. Accordingly, the attenuators allow for easy installation of the barrier system on slopes of many different configurations.

Yet another distinct advantage of the attenuators is that they may not only displace vertically away from the slope, but may also move laterally and then return approximately to their originally deployed locations. For example, a rockfall event could involve a concentrated number of rocks that may strike or otherwise envelop two or more adjacent attenuators. In this case, the attenuators may be forced to move both laterally and vertically due to the inherent unpredictable nature in which the rocks may strike the barrier. Because of the capability of the attenuators to individually move both vertically and laterally, better energy absorption can be achieved without destruction of the barrier system. After termination of the rockfall event, the attenuators will return to their approximate original deployed locations.

The invention may also include a method of mitigating rockfall events in which a barrier is provided including a plurality of resilient and flexible attenuators. The attenuators are secured to an upper portion of the mesh barrier and are capable of displacing laterally and vertically in response to a rockfall event.

A single support cable can be deployed for securing the attenuators and mesh barrier layer(s) to the sloping surface. The cable may be strung laterally across the upper ends of the barrier layer(s). The attenuators can be selectively disposed in a desired configuration such as in serial fashion, side by side, across the barrier layer(s). Two anchor points are provided for securing the support cable to the sloping surface, one located at each end of the cable. The anchor points must be robust anchors to support the system and therefore, the anchor points could comprise multiple anchoring elements. The anchor points may be drilled anchors with sufficient pull-out capacity to withstand significant forces that may be experienced in a rockfall event. Although an advantage of the invention is that only a single support cable may be required for some installations, it should be understood that multiple cables strung together between the anchor points may be another solution for purposes of attaching the attenuators and primary and secondary barrier layers. A multiple cable configuration could include cables arranged serially or in parallel to one another.

Specifically considering the above features of the invention, in one aspect, it may be considered a system for mitigating rockfall events on a sloping surface, the system comprising: a primary barrier layer having a width extending laterally across the sloping surface and a length extending down the sloping surface; a secondary barrier layer placed over the primary barrier layer, said secondary barrier layer having a width extending laterally across the sloping surface and a length extending down the sloping surface; a plurality of attenuators spaced laterally from one another and spaced laterally across the width of the primary barrier layer; a supporting cable extending laterally across the sloping surface, wherein upper portions of the primary and secondary barrier layers are attached to said supporting cable, and each of said plurality of attenuators are secured to said supporting cable; a first anchor point for securing a first end of said supporting cable; and a second anchor point for securing a second opposite end of said supporting cable.

According to another aspect of the invention, the attenuators have separate utility and can be used with other mitigation systems in order to separate any type of barrier layer(s) from a sloping surface and to provide secondary energy absorption for moving objects that strike the attenuators. In this regard, the attenuators may be considered a sub-combination of the invention or elements with separate utility. Accordingly, the attenuators in another aspect of the invention may comprise a body defining an outer surface, an interior surface and a sidewall defined as a thickness between the outer surface and interior surface; a chamber defining a hollow area within said body; a flange having a first end secured within the chamber and a second end protruding through a sidewall of the body, said second end including an eye exposed for connection to a desired implement; said body being made of a resilient and flexible material such that if the body is contacted by an external object with sufficient force, said body will compress in reaction thereto and subsequently decompressed after the force is removed.

According to yet another aspect of the invention, it may be considered a method of mitigating rockfall events on a sloping surface, the method comprising: positioning a primary barrier layer having a width extending laterally across the sloping surface and a length extending down the sloping surface; installing a plurality of attenuators that are spaced laterally from one another and spaced laterally across the width of the primary barrier layer; securing a supporting cable to extend laterally across the sloping surface, wherein an upper portion of the primary barrier layer is attached to said supporting cable, and each of said plurality of attenuators are secured to said supporting cable; installing a first anchor point for securing a first end of said supporting cable, and installing a second anchor point for securing a second opposite end of said supporting cable.

According to yet another aspect of the invention, it may be considered another system for mitigating rockfall events on a sloping surface, the system comprising: a barrier layer having a width extending laterally across the sloping surface and a length extending down the sloping surface; a plurality of attenuators spaced laterally from one another and spaced laterally across the width of the barrier layer, each of said attenuators being constructed of a resilient and flexible material, and said attenuators having an inflatable interior chamber for selected inflation or deflation thereof; a supporting cable extending laterally across the sloping surface, wherein upper portions of the primary barrier layers is attached to said supporting cable, and each of said plurality of attenuators are secured to said supporting cable; and first and second anchor points for securing opposite ends of said supporting cable to the sloping surface.

Other features and advantages of the invention will become apparent from a review of the following detailed description taken in conjunction with the drawings.

DETAILED DESCRIPTION

Figure 1:
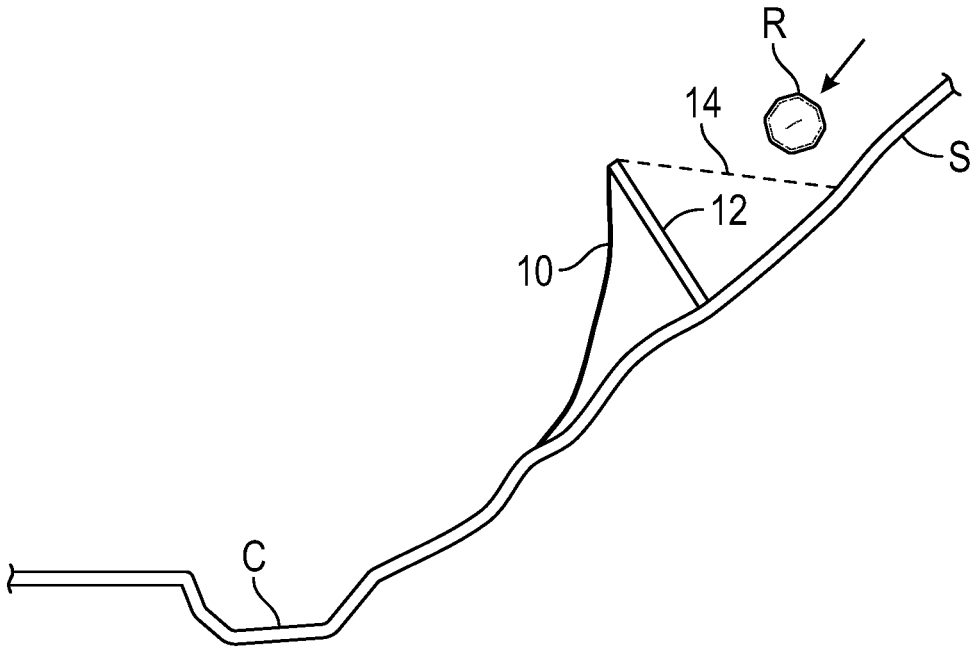
FIG. 1 (PRIOR ART)
FIG. 1 is a schematic view of a prior art barrier system.
Figure 2:
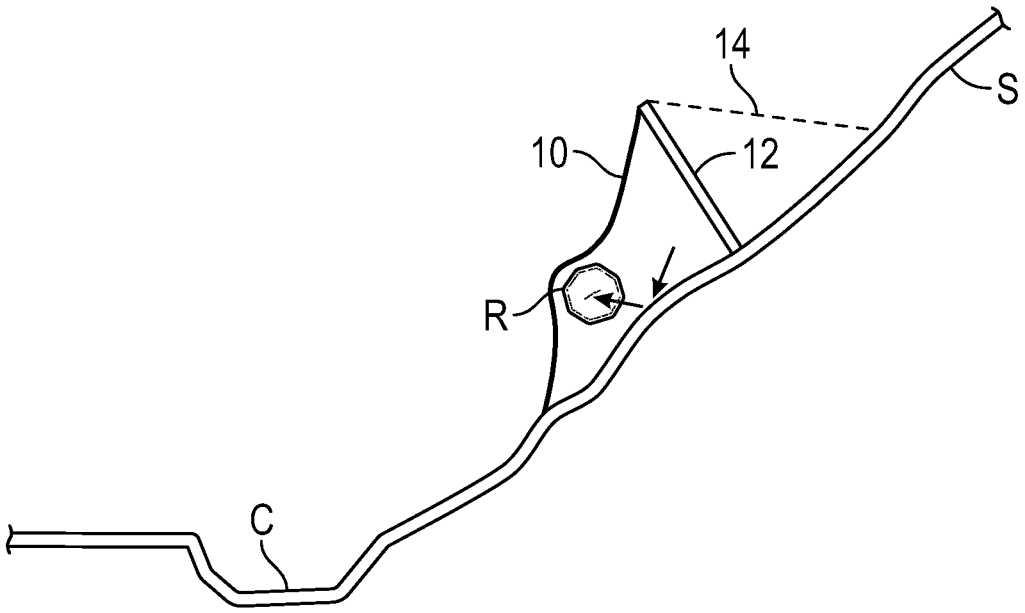
FIG. 2 (PRIOR ART)
FIG. 2 is a schematic view of the prior art barrier system performing under a rock slide event.

FIG. 1 illustrates a typical prior art barrier system mounted on a slope S comprising a plurality of posts 12, anchor cables 14, and one or more layers of barrier mesh 10 that extend down slope. The bottom of the slope may include a catch basin or channel C to trap any rocks/debris that might otherwise further travel into a restricted personnel or equipment area. As shown, a rock R is moving down slope, and in FIG. 2, the rock R is caught between the barrier mesh 10 and the slope S. The momentum of the rock R is slowed by contact with the barrier mesh with the presumption that the barrier system is designed to withstand the force of the falling rocks. As mentioned, there are number of drawbacks associated with the barrier system shown in FIGS. 1 and 2; each of the posts 12 must be installed with one or more rock bolts to support the posts. After the posts are installed, a support wire or cable is strung between adjacent posts. After installation of the support wire, the barrier mesh in one or more layers is then connected and installed. Each of these constructions steps is performed with little or no protection afforded to the workers who are installing the system. After a rockfall event, one or more of the posts may need to be replaced which requires significant additional effort to remove the damaged posts, and reconnect the barrier mesh between the new posts.

Figure 3:
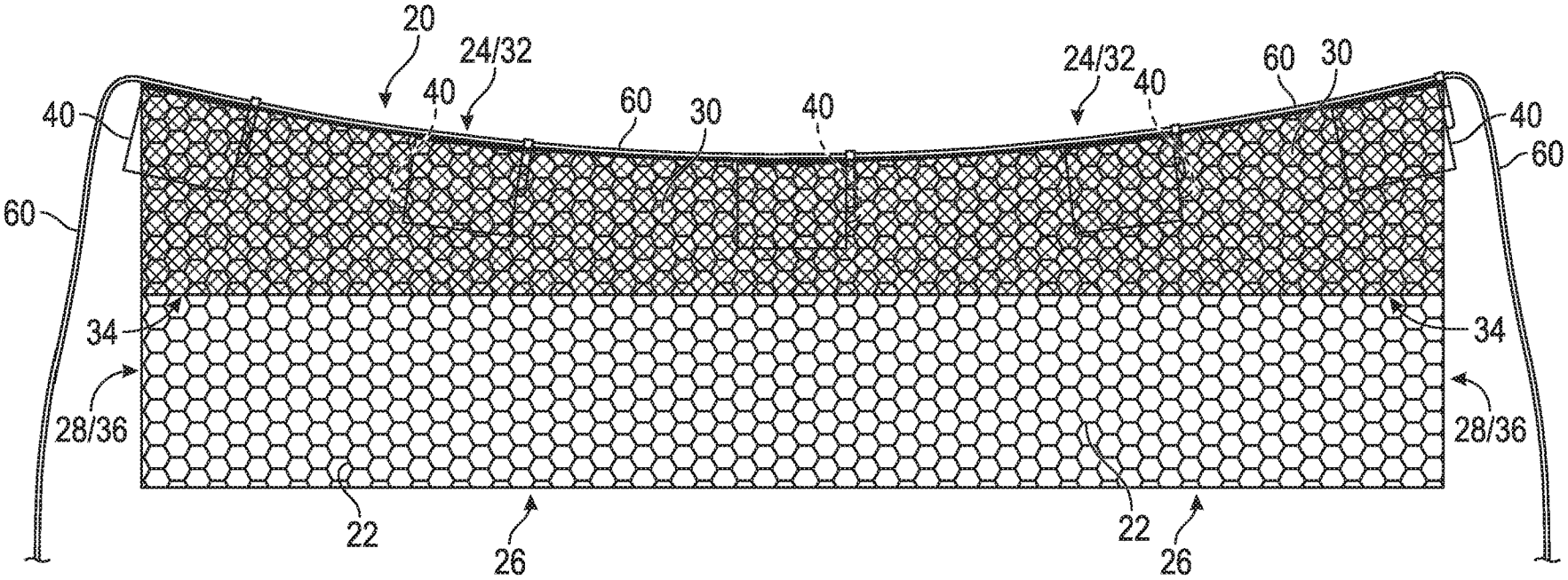
FIG. 3 is an elevation view of the barrier system of the invention.
Figure 5:
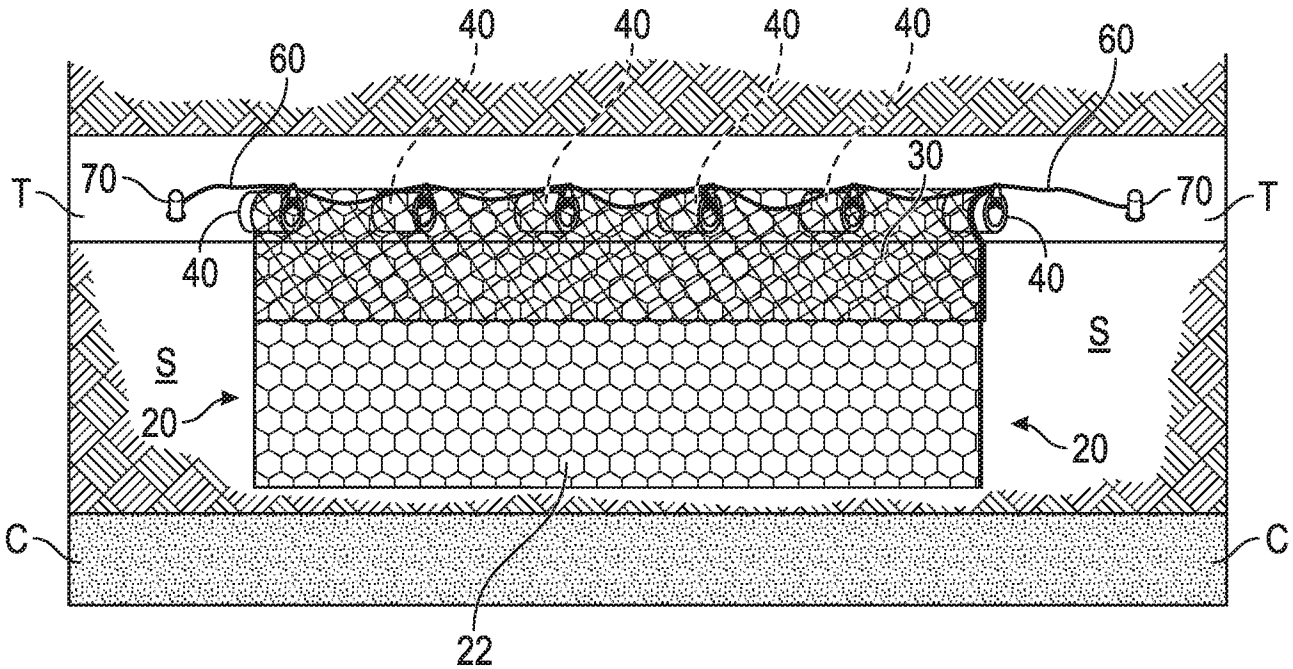
FIG. 5 is a plan view of the barrier system installed on a sloping surface.

Referring to FIGS. 3 and 5, a preferred embodiment of the barrier system 20 of the invention is illustrated. FIG. 3 provides an elevation view of the barrier system, while FIG. 5 provides a plan view of the system as installed on a sloping surface S. FIGS. 3 and 5 show the structural elements of the system which includes a primary barrier mesh 22 and one or more additional layers of secondary barrier mesh 30, such as finer and lighter mesh material as compared to the primary barrier mesh layer 22. As explained further below with respect to a method of installing the system, the layer of fine mesh 30 can be used to deploy the primary barrier mesh 22.

The primary barrier layer 22 is dimensioned so to cover a desired rockfall area; accordingly, the primary barrier layer 22 may be defined as having a top or upper edge 24, a bottom or lower edge 26, and corresponding lateral side edges 28. When deployed in use, one or more fine mesh layers 30 may also be sized to cover a desired rockfall area and to extend a desired distance laterally across and vertically down the slope. Accordingly, the fine mesh layer 30 also includes a top or upper edge 32, a bottom or lower edge 34, and the corresponding lateral side edges 36. In the example of FIG. 3, the fine mesh layer 30 extends partially down the height/length of the primary mesh 22 as shown.

The barrier system 20 further includes a plurality of laterally spaced attenuators or bumpers 40. The attenuators 40 are disposed at the top edges of the primary barrier layer 22 and secondary barrier layer(s) 30. Also referring to FIG. 5, a single supporting cable 60 is routed through corresponding attachment eyes 50 of each of the attenuators 40. The top edges of the primary and secondary barrier layer(s) are also secured to the supporting cable 60.

Although the attenuators 40 are shown in a configuration in which they extend laterally across the sloping surface and being laterally spaced from one another, it should be understood that the attenuators can be selectively arranged in other configurations so that the barrier layer(s) optimally cover a sloping surface. In this regard, the barrier system 20 further includes selective configurations for the attenuators in which one or more attenuators can be positioned downslope from other attenuators in addition to laterally spaced attenuators.

When installed as shown in FIG. 5, the barrier system also includes at least two anchors 70 in which each end of the supporting cable is secured to an anchor 70. The anchors 70 are mounted to a top portion T of the slope S in which the top or upper edges of the primary and secondary barriers are therefore spaced away from the surface of the slope so to catch or otherwise trap rock and debris that may fall downward during a rockfall event. Although the top portion T in this figure is shown as being on a relatively flat area, it should be understood that the anchors 70 can be secured to any flat or sloping part of the sloping surface S.

Figure 4:
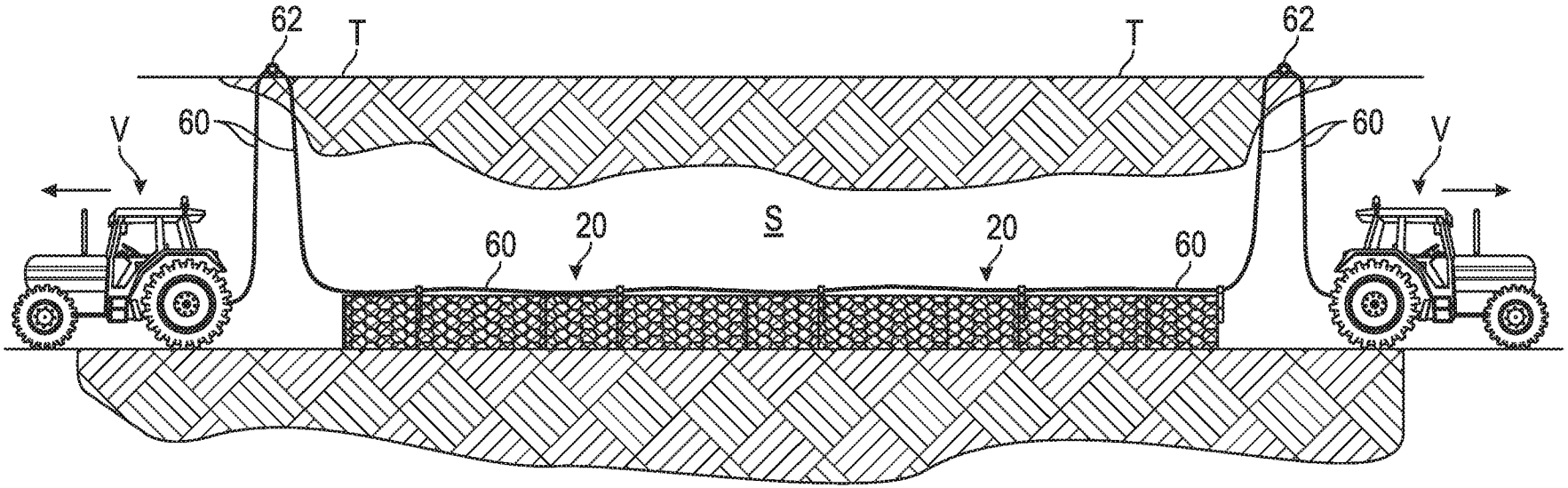
FIG. 4 is an elevation view of the barrier system during installation on a sloping surface.

Referring to FIG. 4, this shows one preferred method of installing the barrier system in which the barrier system is centered along a targeted rockfall area. As shown, each end of the supporting cable 60 is raised to a level that defines the most upper portion of the barrier system, such as the top portion T in the installed system shown in FIG. 5. Each end of the support cable is initially secured to an anchor point 70 and a pulley device 62 secured to the pulley device that may provide mechanical leverage for raising the support cable. Vehicles V or winches (not shown) may be used to raise the barrier system between the pair of pulleys 62 in which the vehicles travel in opposite directions to pull the ends of the supporting cable 60. As the vehicles V move, the barrier system will rise along the slope S until the support cable 60 is raised to a desired height. At this stage, the supporting cable 60 can be secured to the anchors 70. Selected tensioning of the cable 60 is contemplated to allow for a desired amount of lateral and vertical movement of the attenuators 40 in the event of a rockfall event.

As compared to the prior art, it should be apparent that the system 20 of the present invention is significantly easier to install because only two anchor points are required to support the primary and secondary barriers as opposed requiring the installation of a plurality of anchor points on the sloping surface. Additionally, the entire barrier system can be simultaneously raised by simply securing opposite ends of the support cable and providing a force to pull the opposite ends. In this way, workers and other personnel are much better protected during the installation process because the number of workers and/or the amount of time spent at the worksite is substantially minimized.

Figure 6:
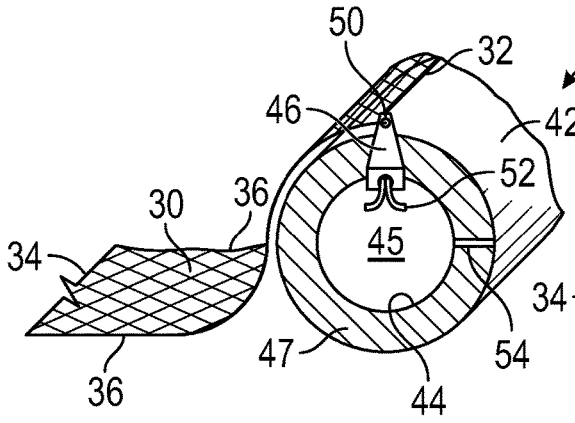
FIG. 6 is a fragmentary cross-sectional view of an attenuator and a barrier mesh secured thereto.

FIGS. 6-11 illustrate a method of deploying the barrier layers 22 and 30, along with details on one preferred embodiment for a construction of the attenuators 40. Referring first to FIG. 6, one example construction is provided for an attenuator 40 in which it has an outer surface 42, an interior surface 44, and a chamber 45 defining a hollow space. A cable-connecting flange 50 is incorporated through the sidewall 47 of the attenuator. The flange 50 includes an eye 50 which receives the support cable 60. The flange 50 is firmly held within the chamber 45 and against the interior surface 44 with the assistance of splines 52 or other securing elements to prevent the flange 50 from being pulled back through the sidewall 47. The attenuator is preferably made of a flexible and resilient material, such as a high-strength rubber compound. The attenuator 40 may be inflated to achieve a desired shape and volume so in this respect, it should be understood that the attenuator 40 can be selectively sized by inflation or deflation. An inflation port 54 is provided to selectively inflate/deflate the attenuator. The particular shape of the attenuator shown in FIGS. 6-11 is cylindrical; however, it should be understood that the attenuator may have other shapes such as spherical.

Figure 7:
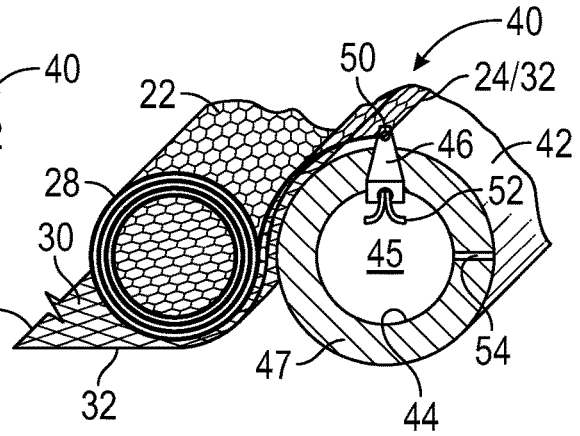
FIG. 7 is another fragmentary cross-sectional view of the attenuator and barrier mesh, along with a lightweight mesh also secured to the attenuator.
Figure 8:
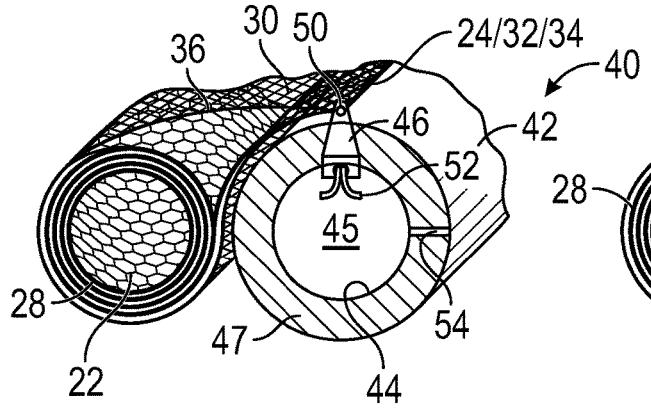
FIG. 8 is another fragmentary cross-sectional view of the attenuator, barrier mesh, and light weight mesh in which the lightweight mesh is secured at both ends to the attenuator for purposes of deploying the barrier mesh.
Figure 9:
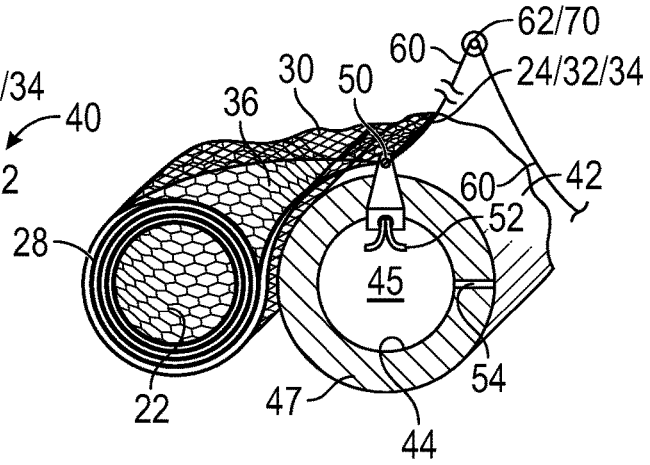
FIG. 9 is another fragmentary cross-sectional view of FIG. 8 further showing a single mounting cable attached to the attenuator, barrier mesh, and lightweight mesh.

According to a first step in preparation of the system for deployment as shown in FIG. 6, the primary barrier 30 has its upper or top edge 32 located adjacent the flange 46. According to a next step as shown in FIG. 7, the primary barrier 22 is provided in a rolled configuration, and its top or upper edge 24 is also located adjacent the flange 46. According to a next step as shown in FIG. 8, the lower or bottom edge 34 of the secondary barrier is pulled up to cover the primary barrier 22 and the bottom edge 34 is also located adjacent the flange 46. According to a next step as shown in FIG. 9, the support cable 60 is routed through the eye 50 of the flange 46 thereby securing the top edge 24 of the primary barrier, and the top and bottom edges 32 and 34 of the secondary barrier. In this configuration, the secondary barrier 30 serves as a supporting wrap or supporting basket for the primary barrier 22.

Figure 10:
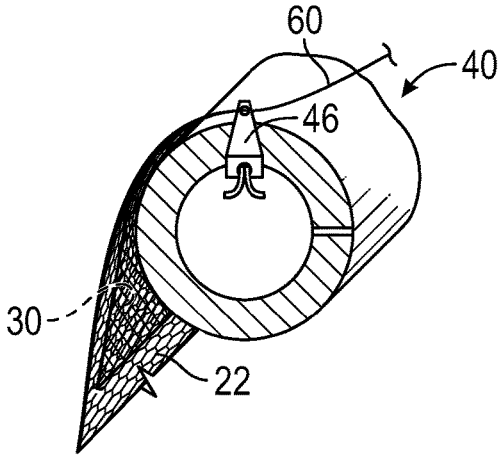
FIG. 10 is another fragmentary-cross-sectional view of FIG. 9 showing the barrier system deployed in which one end of the lightweight mesh is released to allow the barrier mesh to unroll.

FIG. 10 shows deployment of the barrier layers in which the bottom edge 34 of the secondary barrier layer is released which allows the primary barrier layer 22 to unroll and therefore extend down over the sloping surface.

Figure 11:
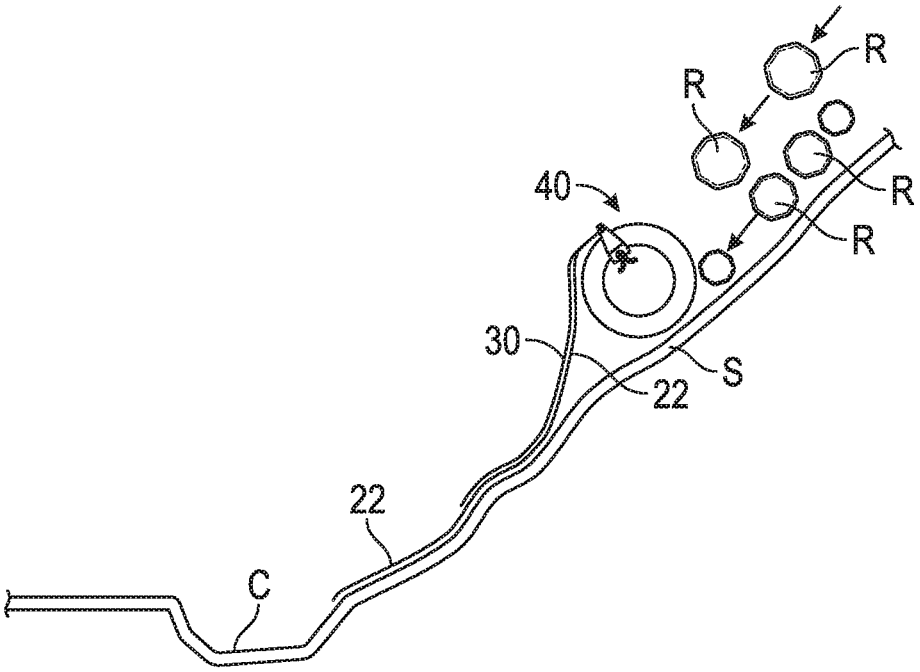
FIG. 11 is a schematic view of the system of the invention prior to a rockfall event.
Figure 12:
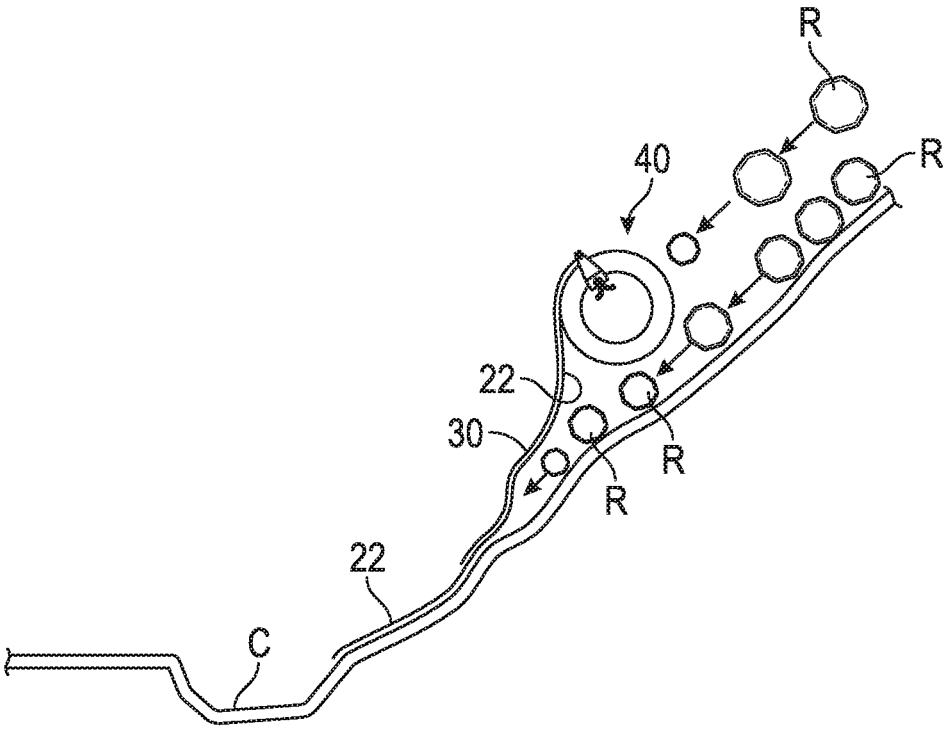
FIG. 12 is another schematic view of the system of the invention during a rockfall event in which an attenuator can be displaced vertically and/or laterally in response to the force of the falling rocks.

FIG. 11 is a schematic side view of the system of the invention as installed on a sloping surface S. Specifically, FIG. 11 illustrates a rock fall attenuator 40 with a primary barrier layer 22 and a secondary barrier layer 30 extending down the slope. A group of rocks R from a rock fall approach the system. FIG. 12 illustrates a rockfall event in which the attenuator 40 may be displaced upward away from the slope S as caused by rocks which may strike the attenuator and those rocks which may therefore travel underneath the attenuator. As also mentioned, the attenuator may also react to the force of a rock fall by lateral movement along the slope in which, depending upon the tension placed on the support cable 60, the attenuator will have at least some ability to laterally displace. During a rockfall event, it is also possible that rocks will not have sufficient force to vertically raise or laterally displace the attenuators in which case, the attenuators may experience some slight movement on the slope, but in any event, will remain in place to allow rocks to pass between the attenuators. Another advantage of the attenuators is that rocks making a direct hit on the attenuators will be slowed since the attenuators themselves have an inherent energy absorption feature by incorporation of the rubber composite material along with an inflatable characteristic enabling the attenuators to deform in response to force from a striking rock.

From the foregoing, it should be apparent that there are number of structural features of the invention that provide benefits over the prior art. The attenuators achieve an enhanced function for raising the barrier layer(s) away from the slope without requiring any of the attenuators to be actually attached to the slope. Installation or deployment of the system is simplified by use of a single support cable that may be raised to a desired height by only two anchor points. The physical force required to raise the barrier may be achieved simultaneously by opposite traveling vehicles or opposite pulling winches that pull opposite ends of the supporting cable.

There are a number of advantages of the invention. The system is easily installed since anchoring of the system is simplified with two primary anchor points in which the entire barrier can be raised with pulleys located at each anchor point. This simplified method of deploying the system makes the system a mobile solution for rockfall mitigation. The same system can be re-used in multiple installations because the attenuators are pre-secured to the barrier layers and because the attenuators are not permanently attached to the sloping surface of the rockfall area. Use of pulleys to raise and lower the barrier system allows it to be deployed and removed with existing equipment, such as jobsite vehicles, that can supply the needed force for raising and lowering the barrier system. The attenuators can be selectively arranged at various locations on the primary barrier to account for the specific shape or orientation of the sloping surface therefore enabling the system to be installed at many locations.

Although the invention is described herein with respect to one or more preferred embodiments relating to a system, method, and sub combinations of the system, it shall be understood that the invention can be modified beyond the specific disclosure of the preferred embodiments commensurate with the scope of the claims appended hereto.

What is claimed is:

1. A system for mitigating rockfall events on a sloping surface, the system comprising:

a primary barrier layer having a width extending laterally across the sloping surface and a length extending down the sloping surface;

a secondary barrier layer placed over the primary barrier layer, said secondary barrier layer having a width extending laterally across the sloping surface and a length extending down the sloping surface;

a plurality of attenuators spaced laterally from one another and spaced laterally across the width of the primary barrier layer;

a supporting cable extending laterally across the sloping surface, wherein upper portions of the primary and secondary barrier layers are attached to said supporting cable, and each of said plurality of attenuators are secured to said supporting cable;

a first anchor point for securing a first end of said supporting cable; and a second anchor point for securing a second opposite end of said supporting cable.

2. A system, as claimed in claim 1, wherein:

said attenuators are constructed of a resilient and flexible material, and said attenuators having an inflatable interior chamber for selected inflation of the attenuators to achieve the desired size or shape.

3. A system, as claimed in claim 1, wherein:

said primary barrier includes a first mesh configuration and said secondary barrier includes a second different mesh configuration.

4. A system, as claimed in claim 1, wherein:

said attenuators are substantially evenly spaced from one another laterally across the width of the primary barrier layer.

5. A system, as claimed in claim 1, wherein:

said attenuators are each of substantially a same size and shape.

6. A system, as claimed in claim 1, wherein:

said attenuators include at least one attenuator that has a substantially different size and shape as compared to other attenuators.

7. An energy absorbing attenuator adapted for use within a rockfall mitigation system, said attenuator comprising;

a body defining an outer surface, an interior surface and a sidewall defined as a thickness between the outer surface and interior surface;

a chamber defining a hollow area within said body;

a flange having a first end secured within the chamber and a second end protruding through a sidewall of the body, said second end including an eye exposed for connection to a desired implement;

said body being made of a resilient and flexible material such that if the body is contacted by an external object with sufficient force, said body will compress in reaction thereto and subsequently decompressed after the force is removed.

8. The attenuator, as claimed in claim 7, further comprising:

at least one anchoring element connected to said flange and disposed within said chamber for anchoring said flange within said chamber to prevent said flange from being pulled through said sidewall.

9. A method of mitigating rockfall events on a sloping surface, the method comprising:

positioning a primary barrier layer having a width extending laterally across the sloping surface and a length extending down the sloping surface;

installing a plurality of attenuators that are spaced laterally from one another and spaced laterally across the width of the primary barrier layer;

securing a supporting cable to extend laterally across the sloping surface, wherein an upper portion of the primary barrier layer is attached to said supporting cable, and each of said plurality of attenuators are secured to said supporting cable;

installing a first anchor point for securing a first end of said supporting cable, and installing a second anchor point for securing a second opposite end of said supporting cable.

10. A method, as claimed in claim 9, wherein:

at least one attenuator of said plurality of attenuators traverses laterally along the sloping surface from a first position to a second different lateral position separated from the first position in response to a rockslide contacting said primary barrier or said plurality of attenuators.

11. A method, as claimed in claim 9, wherein:

at least one attenuator of said plurality of attenuators moves vertically away from and separated from the sloping surface from a first position to a second different separated position separated from the first position in response to a rockslide contacting said primary barrier or said plurality of attenuators.

12. A method, as claimed in claim 9 further including:

positioning a secondary barrier layer placed over the primary barrier layer, said secondary barrier layer having a width extending laterally across the sloping surface and a length extending down the sloping surface.

13. A system for mitigating rockfall events on a sloping surface, the system comprising:

a barrier layer having a width extending laterally across the sloping surface and a length extending down the sloping surface;

a plurality of attenuators spaced laterally from one another and spaced laterally across the width of the barrier layer, each of said attenuators being constructed of a resilient and flexible material, and said attenuators having an inflatable interior chamber for selected inflation or deflation thereof;

a supporting cable extending laterally across the sloping surface, wherein upper portions of the primary barrier layers is attached to said supporting cable, and each of said plurality of attenuators are secured to said supporting cable; and first and second anchor points for securing opposite ends of said supporting cable to the sloping surface.

14. A system, as claimed in claim 13, further including:

a secondary barrier placed over said primary barrier layer.

15. A system, as claimed in claim 14, wherein:

said primary barrier includes a first mesh configuration and said secondary barrier includes a second different mesh configuration.

16. A system, as claimed in claim 13, wherein:

said attenuators are substantially evenly spaced from one another laterally across the width of the primary barrier layer.

17. A system, as claimed in claim 13, wherein:

said attenuators are each of substantially a same size and shape.

18. A system, as claimed in claim 13, wherein:

said attenuators include at least one attenuator that has a substantially different size and shape as compared to other attenuators.

* * * * *